United States Patent [19]

Nishikawa

[11] 4,367,037

[45] Jan. 4, 1983

[54] TEMPERATURE CONTROLLER FOR PHOTOGRAPHIC HEAT FIXING UNIT

[75] Inventor: Masaji Nishikawa, Hachioji, Japan

[73] Assignee: Olympus Optical Company Ltd., Tokyo, Japan

[21] Appl. No.: 250,067

[22] Filed: Apr. 1, 1981

[30] Foreign Application Priority Data

Apr. 25, 1980 [JP] Japan ..... 55-55091

[51] Int. Cl.[3] ..... G03G 15/00; H05B 1/02

[52] U.S. Cl. ..... 355/14 FU; 355/3 FU; 219/216; 219/469; 118/641; 432/4; 432/12; 432/35

[58] Field of Search ..... 355/14 FU, 3 FU, 14 TR, 355/3 TR, 14 SH, 3 SH; 430/130; 432/4, 10, 12, 34, 35; 219/216, 469; 118/641

[56] References Cited

U.S. PATENT DOCUMENTS

| | | | |
|---|---|---|---|
| 3,778,222 | 12/1973 | Suzuki | 432/35 |
| 4,075,455 | 2/1978 | Kitamura et al. | 219/216 |
| 4,087,676 | 5/1978 | Fukase | 219/216 |
| 4,145,599 | 3/1979 | Sakurai et al. | 219/216 |
| 4,162,847 | 7/1979 | Brandon | 355/14 FU |
| 4,259,565 | 3/1981 | Ogino et al. | 219/216 |
| 4,267,434 | 5/1981 | Simpson | 219/216 X |
| 4,301,359 | 11/1981 | Ito et al. | 219/216 |

*Primary Examiner*—A. C. Prescott

*Attorney, Agent, or Firm*—Weinstein & Sutton

[57] ABSTRACT

A temperature controller for photographic heat fixing unit which may be used in an electrophotographic copying apparatus includes a main temperature for detecting the temperature of a heater or heaters in the fixing unit and an auxiliary temperature sensor for detecting the temperature of a marginal member spaced from the heater or of a record sheet. The temperature level of the fixing unit is controlled in accordance with outputs from the both temperature sensors.

16 Claims, 18 Drawing Figures

| CURVES | LOCATION | THERMISTOR ø | THERMISTOR LENGTH | RECORD SHEET |
|---|---|---|---|---|
| ① | Ⓔ | 1.2 ø | 3 mm | 75 g/m² |
| ② | Ⓔ | 1.2 ø | 3 mm | 60 g/m² |
| ③ | Ⓓ·Ⓕ | 1.8 ø | 5 mm | 75 g/m² |
| ④ | Ⓓ·Ⓕ | 1.8 ø | 5 mm | 60 g/m² |
| ⑤ | Ⓔ | 2.2 ø | 6 mm | 75 g/m² |
| ⑥ | Ⓔ | 2.2 ø | 6 mm | 60 g/m² |

| CURVES | RECORD SHEET | DISTANCE | NOTE |
|---|---|---|---|
| I | 75 g/m² | 2 mm | THE SAME AS CURVE ③ IN FIG. 11 |
| II | 60 g/m² | 2 mm | THE SAME AS CURVE ④ IN FIG. 11 |
| III | 75 g/m² | 3 mm | |
| IV | 60 g/m² | 3 mm | |
| V | 75 g/m² | 5 mm | |
| VI | 60 g/m² | 5 mm | |

TEMPERATURE CONTROLLER FOR PHOTOGRAPHIC HEAT FIXING UNIT

BACKGROUND OF THE INVENTION

The invention relates to a temperature controller for a photographic heat fixing unit, and more particularly, to such a controller used in an electrophotographic copying apparatus in which a temperature sensor detects the temperature of a heat fixing unit and produces an output which is utilized to control the operating temperature of the unit.

A photographic heat fixing unit which is used in an electrophotographic copying apparatus to fix a toner image generally comprises an open heater fixing unit internally housing a ribbon-shaped heater or a wire heater, a radiant heater fixing unit which utilizes a halogen lamp or an infrared lamp, or a heat roll fixing unit which utilizes heated rolls. It is mandatory that the operating temperature of such fixing units be controlled to a point where a satisfactory fixing operation is assured. To this end, such a unit includes a temperature sensor and an associated control circuit. However, in conventional arrangements for controlling the temperature of described heat fixing units, although the temperature of the location where a temperature measurement is made can be maintained constant, such temperature is not always in coincidence with the temperature which is required to achieve a toner fixing, thereby causing various drawbacks. By way of example, the fixing situation which prevails immediately after the power switch of the fixing unit has been turned on is different from the fixing situation after a number of copies have been produced in succession or after the unit has been maintained in its standby mode while heating it over a prolonged period of time. It is sometimes possible that a record sheet may be scorched or burnt before or after the fixing operation. Additionally, an improper fixing temperature may cause a so-called offset of a toner image. As is recognized, a proper fixing condition greatly depends on the thickness and the hygroscopic degree of a record sheet, but a conventional fixing unit failed to provide a satisfactory control.

One form of electrophotographic copying apparatus in which a heat fixing unit is incorporated will now be described with reference to FIG. 1. The apparatus is shown in its normal condition in which a single sheet-shaped original is adapted to be fed along its conveying path. A sheet-shaped original 1 is placed on an inclined original guide 2 and is inserted into an inlet opening of an original feeder in a direction indicated by an arrow A, the feeder comprising pairs of conveying rollers 4A, 4B, 5A, 5B and a pair of guide plates 6, 7. As the original 1 moves into the nip between the pair of rollers 4A, 4B, it is conveyed toward an exposure station 8. It then passes between the pair of guide plates 6, 7 and between the guide plate 6 and the exposure station 8. After passing through the exposure station 8, the original 1 is further conveyed by the pair of rollers 5A, 5B onto an original tray 9.

As the original 1 is conveyed by the original feeder, a pair of microswitches 3A, 3B, located on the opposite sides of the conveying rollers 4A, 4B, operate to detect the location of the original 1 and produce outputs which are utilized for controlling the timing of operation of various parts of the apparatus. As the original 1 passes through the exposure station 8, an illumination lamp 10 projects light onto the surface of the original, whereby an optical system 11 projects an optical image of the original onto a photosensitive drum 12. The drum 12 is adapted to rotate in a direction indicated by an arrow B, and is electrically neutralized by a neutralizer lamp 13 and is then uniformly charged by a corona charger 14 before it is irradiated with the optical image of the original to thereby form an electrostatic latent image of the original 1 on its surface. The latent image is developed by a developing unit 15 of the dry type, and is then carried to a toner image transfer station 16 as the drum 12 continues to rotate. On the other hand, a number of record sheets 18 are contained in a stack within a cassette 17, and are fed one by one by an oscillating and rotating feed roller 19 so as to be conveyed to the transfer station 16 by a pair of vertically spaced feed rollers 20 at a given timing. The record sheet 18 is conveyed into the nip between the drum 12 and a transfer roller 21, to which a bias voltage is applied, so that the sheet is brought into overlapping relationship with the toner image on the drum 12, thus allowing the toner image to be transferred to the sheet. Since it is possible that the record sheet be carried by the drum 12 while it is in close contact therewith, the sheet is separated therefrom by the action of a separating claw 22 and an airstream to be described later. After the toner image is transferred to the record sheet, the latter is then conveyed along a guide 23 and is then fed by a pair of vertically aligned feed rollers 24 into a heat fixing unit 25 of the open type where the toner image is melted and fixed to the sheet. Subsequently, the sheet is delivered onto a copy tray 27 through an outlet 35, by the action of a pair of vertically aligned delivery rollers 26.

Any small amount of residual toner which remains on the drum 12 without being transferred to the record sheet is scraped off by a rotating cleaning brush 28 and withdrawn into an airstream created by a fan 29 to be collected by a filter 30. Both the cleaning brush 28 and the fan 29 are covered within a case 31 in order to produce an effective displacement of the residual toner and to prevent a dispersion of the toner within the apparatus. The airstream displaced by the fan 29 is introduced into a duct 32 which has its outlet port **32*a* located adjacent to the transfer station 16 so that it can be utilized to achieve an effective separation of the record sheet from the drum 12 by cooperation with the separating claw 22**.

The illustrated electrophotographic copying apparatus is arranged to provide a plurality of copies in succession through the repetition of a developing of the electrostatic latent image once formed on the drum 12 with toner and a subsequent transfer step. When the apparatus is so used, the cleaning brush 28 mounted on a holder 34 which is pivotally mounted on a pin 33 is moved away from the drum 12 and both the neutralizer lamp 13 and the charger 14 are disabled.

FIG. 2 is a cross section showing the heat fixing unit 25 used in the described electrophotographic copying apparatus in more detail while FIG. 3 is a plan view taken along the line X—X shown in FIG. 2. In FIGS. 2 and 3, there are shown a pair of containers 41, 42 in the form of metal boxes which are open at their one end and internally housing band-shaped heaters 43, 44, respectively, which are mounted on support members **47*a*, 47*b* and 48*a*, 48*b*, respectively. The containers 41, 42 are disposed in spaced, opposing relationship with each other on the upper and the lower side of a path 51** along which the record sheet carrying the transferred toner image is conveyed, with their openings 41*a*, 42*a* facing toward each other. The support members 47*a*, 47*b*, 48*a*, 48*b* are formed of an electrically insulating, refractory material such as ceramics, and are secured to the top wall of the container 41 and the bottom wall of the container 42 along their opposite lateral ends. A plurality of band-shaped heaters 43, 44 extend across the support members 47*a*, 47*b* and 48*a*, 48*b*.

These heaters 43, 44 are formed as strips, having a sheet thickness on the order of 0.05 to 0.2 mm, of an electrical resistance material such as iron chrome, nickel chrome or the like, and may be painted with a black paint, if required. It will be noted that the heaters 43, 44 are disposed toward the respective openings 41*a*, 42*a* of the containers 41, 42 and have their opposite ends secured to steps formed in the individual support members 47*a*, 47*b*, 48*a*, 48*b* by set screws 45. When the plurality of heaters 43, 44 are secured to the support members by set screws 45, they are connected in series with each other by conductive strips 46 disposed on the individual support members. The series combination of heaters 43, 44 are connected through a switch to an a.c. source, not shown.

A plurality of guides 49, 50 in the form of thin wires extend across the openings 41*a*, 42*a* of the containers 41, 42 generally in a direction parallel to the direction of movement of the record sheet. As shown, the guides 49, 50 are disposed to be further spaced from each other, as viewed in a direction indicated by an arrow $B_0$ or in the direction of movement of the record sheet, thereby assuring a smooth conveying of the record sheet without causing a jamming in the path 51. Referring to FIG. 2, it will be noted that the pair of feed rollers 24 and the pair of delivery rollers 26, disposed on the opposite sides of the path 51 extending through the fixing unit forcedly convey the record sheet along the path 51.

Heat resistant members 52, 53 are applied to the inside of the top wall of the container 41 and of the bottom wall of the container 42 to provide a heat insulation and an electrical insulation. Heat insulating plates 54, 55 are applied to the external surface of the top wall of the container 41 and of the bottom wall of the container 42.

A temperature sensor 56 such as a thermistor is disposed close to or in contact with one of the heaters 43 in the photographic heat fixing unit 25 for detecting the operating temperature of the heater. By providing such a sensor, a temperature controller is associated with the fixing unit 25 for controlling the operating temperature of the heaters 43, 44 to a given value. The fixing unit 25 shown exhibits a rapid temperature rise upon energization of the heaters 43, 44, and permits a fixing operation to be initiated within ten to fifteen seconds. The temperature control of the heaters 43, 44 has been performed by utilizing a temperature controller as shown in FIG. 4.

FIG. 4 is a circuit diagram of one form of conventional temperature controller. The controller includes a pair of terminals 70, 71 across which a d.c. voltage of a given magnitude is applied. A thermistor $S_1$ or the temperature sensor 56 which detects the operating temperature of the heater 43 is connected in series with a resistor 72 across the terminals to form a circuit which produces a detection signal. A reference voltage circuit is formed by a series combination of a variable resistor 73 and a fixed resistor 74, and is connected in parallel with the sensor circuit. The potential appearing at a junction P between the thermistor $S_1$ and the resistor 72 and the potential appearing at a junction $P_0$ between the variable resistor 73 and the resistor 74 are introduced into a comparison and detection circuit 75 where they are compared against each other. The reference voltage at the junction $P_0$ can be preset to a proper value by adjusting the variable resistor 73. The comparison and detection circuit 75 produces an output which is effective to reduce the potential difference between the junction P, $P_0$. The output is applied to an amplification control circuit 76 which controls the energization of the heaters 43, 44. FIG. 5 shows the circuit arrangement more specifically. The comparison and detection circuits 75 comprises an operational amplifier 77 combined with resistors 78 to 81. The inverting input terminal of the amplifier 77 is connected to the junction P while the non-inverting input terminal is connected to the junction $P_0$. A feedback resistor 78 is connected across the non-inverting input terminal and the output terminal of the amplifier 77. A series combination of resistors 79, 80 and 81 is connected across the terminals 70, 71, with the junction between the resistors 79, 80 being connected to the output terminal of the amplifier 77 and the junction between the resistors 80, 81 being connected to the input of the control circuit 76, which is also connected with the terminal 71. The control circuit 76 is arranged to control a power supply 82 associated with the heaters 43, 44.

It is to be noted that the temperature control of the fixing unit is achieved by merely detecting the operating temperature of the heaters 43, 44. By experiment, it has been recognized that the following problems are presented when the heat fixing unit 25 is controlled by utilizing the temperature sensor 56 alone:

(1) When a fixing operation is performed shortly after the energization of the fixing unit which has reached a sufficient temperature to permit a fixing operation, the amount of heat generated is significantly less than that produced during a fixing operation which is performed after a number of copies have been produced in succession. Consequently, a dissatisfactory fixing may result when initiated shortly after the energization of the fixing unit.

(2) When a number of copies are produced in succession, the temperature of the record sheet or delivery rollers 26 may rise excessively, causing a scorching of the record sheet or an offset of the toner image by the delivery rollers 26.

(3) When a thick record sheet or a relatively humid record sheet is used, the fixing result may be insufficient. On the other hand, when a thin or a dry record sheet is used, a satisfactory fixing operation may be achieved, but leaves the likelihood that the record sheet may be scorched or an offset of the toner image may be caused by the delivery rollers 26.

These problems cannot be overcome with the conventional temperature control system in which the heaters 43, 44 are energized to a given level and maintained at such level. The problems mentioned under subparagraphs (1) and (2) are attributable to the fact that while a given temperature is maintained at the location where the temperature is sensed other members of the fixing unit 25, for example, the containers 41, 42, the support members 47*a* to 48*b* or the like exhibit a temperature rise at a rate which is greatly lower than that of the heaters 43, 44 and that the temperature rise of members other than the heaters 43, 44 may also contribute to the heating of the record sheet.

The problem mentioned under the subparagraph (3) is attributable to a variation in the heat capacity of the record sheet itself, and hence an essential solution cannot be attained unless the temperature control takes the heat capacity of the record sheet into consideration.

It will be evident from the foregoing description that these problems are present, not only in the heat fixing unit 25 of the open type mentioned above, but also are present in common in every heat fixing unit which is operatively used while its temperature is being controlled.

FIG. 6 is a cross section of one form of heat roll fixing unit which is known in itself. A fixing unit 66 comprises a pair of rolls 60, 61 which are formed by cylindrical metal pipes and which are provided with coatings 62, 63 of polytetrafluoroethylene, silicone rubber or the like on the surface of the rolls. A heater 64 is disposed inside the roll 61. The temperature control of the heat roll fixing unit 66 is achieved by utilizing a heat transfer strip 65 disposed in contact with the surface of the heat roll 61 and a temperature sensor 56 carried thereby. The heat roll fixing unit 66 exhibits a slow temperature rise, and allows a fixing operation to be initiated after a time interval from one to ten minutes upon energization thereof. Accordingly, it is normally energized so that a given temperature is maintained while it is in its steady mode. However, when a temperature is reached after it is initially energized, members located around the heat roll 61 still assume a low temperature while these members reach a higher temperature when the unit is in its standby mode or after a number of copies have been produced in succession. Consequently, a fixing result of the record sheet is dependent upon the heat of these members. With the heat roll fixing unit 66, an offset may be caused in a temperature region which is either higher or lower than the proper temperature, and hence a change in the fixing performance cannot be neglected. Obviously, the fixing performance also depends on the thickness of the record sheet as well as the hygroscopic degree thereof in the same manner as experienced with the fixing unit of the open type.

SUMMARY OF THE INVENTION

It is an object of the invention to eliminate the described difficulties of the conventional heat fixing unit, by providing a temperature controller for a photographic heat fixing unit in which a proper temperature control is assured by the provision of an auxiliary temperature sensor or sensors for detecting the temperature of members located around a heater, in addition to a main temperature sensor which detects the operating temperature of the heater itself.

In accordance with the invention, the provision of an auxiliary temperature sensor or sensors which detect the temperature of the members located remote from the heater, separately from the main sensor which detects the operating temperature of the heater, permits a correction of the temperature control by the main sensor in accordance with an output from the auxiliary sensor or sensors. Accordingly, a significant temperature shift among marginal members and record sheet is avoided between a fixing operation which occurs shortly after the energization of the fixing unit and a fixing operation which occurs after a number of copies have been produced in succession, thus assuring substantially uniform control. A degradation in the fixing performance which has been experienced in the prior art as a result of differential heat capacities of the record sheets or the difference between a single and a successive copying operation is eliminated. An offset of a toner image by the delivery rolls or insufficient fixing as well as a scorching of the record sheet are also eliminated. In this manner, the fixing operation is greatly stabilized.

DESCRIPTION OF PREFERRED EMBODIMENTS

Figure 1:
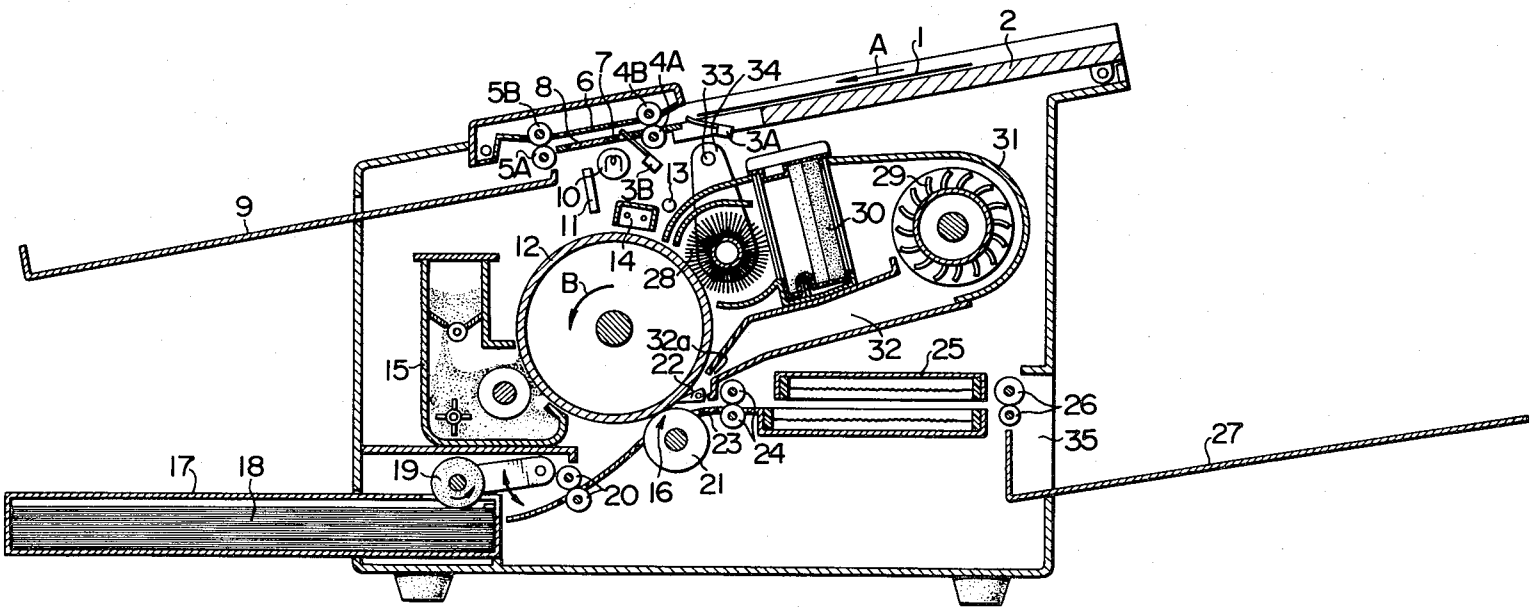
FIG. 1 is a cross section of one form of electrophotographic copying apparatus.
Figure 7:
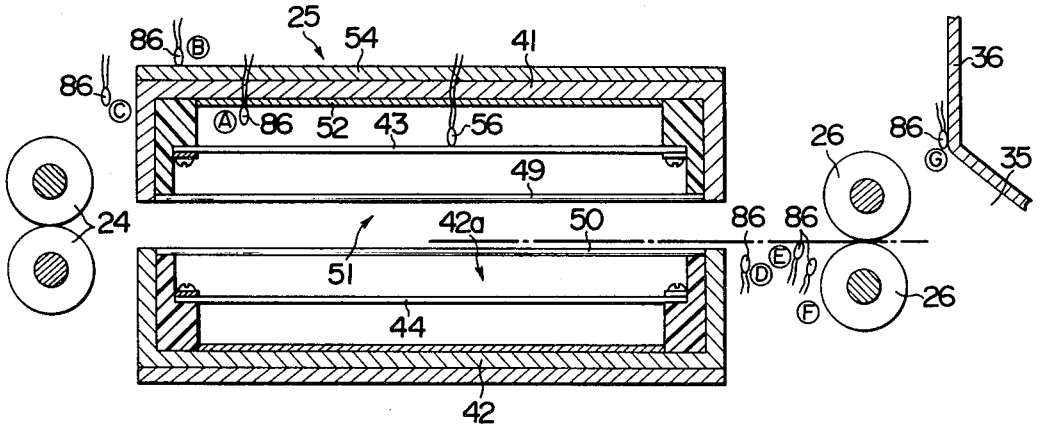
FIG. 7 is a cross section of a heat fixing unit, illustrating an arrangement of auxiliary temperature sensor or sensors in the apparatus of the invention.

FIG. 7 is a cross section of a photographic heat fixing unit illustrating an exemplary arrangement of auxiliary temperature sensors in the temperature controller of the invention. The fixing unit shown is the same as the heat fixing unit 25 of the open type shown in FIGS. 2 and 3, and therefore will not be described. The temperature controller according to the invention includes, in addition to a main temperature sensor 56 disposed close to or in contact with the heaters 43 of the fixing unit 25, one or more auxiliary temperature sensors 86 which operate to detect the temperature of marginal members which are gradually heated as the fixing unit continues to be energized. In the example shown, the auxiliary sensors 86 are disposed at suitable locations as designated by letters A to G in order to detect the prevailing temperatures at these locations for correcting the temperature level of the fixing unit. When the auxiliary sensor 86 is disposed at location A which is close to the heat resistant member 52 and remote from the heater 43 within the fixing unit, it detects the temperature of the internal atmosphere of the fixing unit. The auxiliary sensor disposed at location B which is close to the heat insulating plate 54 outside the fixing unit detects a temperature rise of the container 41. At location C which is removed from the container 41 on the inlet side thereof, the sensor detects a temperature rise of the container 41 through an air layer. It is to be noted that the rate of temperature rise detected by the sensors 86 disposed at locations A to C is significantly lower than the rate of temperature rise of the heaters 43, 44, such rate decreasing in the sequence of the sensors disposed at locations A, B and C. The auxiliary temperature sensors 86 may also be disposed at locations D to G which are distributed around the delivery rollers 26 arranged outside of the fixing unit 25. When the sensor is disposed at location D, it detects the temperature of a point which is close to the fixing unit 25 but which is slightly lower in elevation than the path of the record sheet. At location E, the sensor is disposed for contact with the record sheet as it is delivered out of the path 51 to detect its temperature. At location F, the sensor detects the temperature at a point which is close to the delivery rollers 26 and slightly lower in elevation than the path of the record sheet. At location G, the sensor detects the temperature of a point inside the outer cover 36 adjacent to the outlet opening 35 of the copying apparatus (see FIG. 1). The choice of one or more of the locations A to G or other locations where the auxiliary temperature sensor or sensors 86 are to be disposed should be made to allow a rising rate or sensor output to be obtained which permits an optimum correction of a change in the fixing performance which occurs as a result of a continuous energization of the fixing unit 25. By experiments, it is found that when the auxiliary sensor 86 is disposed at location E or on the path of the record sheet, the temperature of the record sheet immediately after the completion of the fixing operation can be satisfactorily detected without causing any interference with the running of the record sheet.

Figure 8:
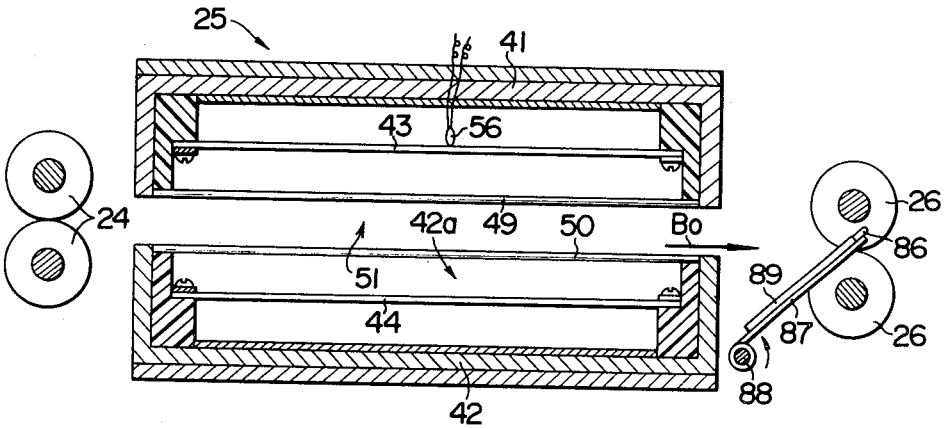
FIG. 8 is a cross section of a heat fixing unit, illustrating another arrangement of an auxiliary temperature sensor.

FIG. 8 shows a specific arrangement in which the auxiliary sensor 86 is disposed at location where it a can detect the temperature of record sheet immediately after it has been fixed. The auxiliary sensor 86 is mounted on a support arm 87 which has its lower end pivotally mounted on a support shaft 88 disposed toward the bottom of the lower container 42 and intermediate the container 42 and the delivery roller 26. The support arm 87 is disposed at an angle to extend between the rollers 26 so that its upper end is located slightly above the nip between the delivery rollers 26. As shown in exaggerated form in FIG. 9, the support arm 87 is integrally provided with a pipe 89, on the upper end of which the auxiliary sensor 86 is disposed. At this end, the upper end of the pipe 89 is formed with a notch **89*a* so as to expose a temperature sensing portion of the sensor 86. The auxiliary sensor 86 includes a pair of lead wires 86*a* which extend through the pipe 89 to be connected to an electrical circuit of the temperature controller at the lower end of the support arm 87. The support arm 87 is urged to rotate counter-clockwise about the shaft 88** by a spring, not shown, and normally assumes the position shown by abutment against a stop, not shown.

When the record sheet runs in the direction of the arrow $B_0$ on the path 51, and becomes held between the pair of delivery rollers 26 immediately after it has left the fixing unit 25, it bears against the support arm 87 to urge it down, whereby the auxiliary sensor 86 is maintained in contact with the moving record sheet to detect the temperature of the record sheet immediately after the fixing operation as the record sheet moves through the nip between the rollers 26.

Figure 2:
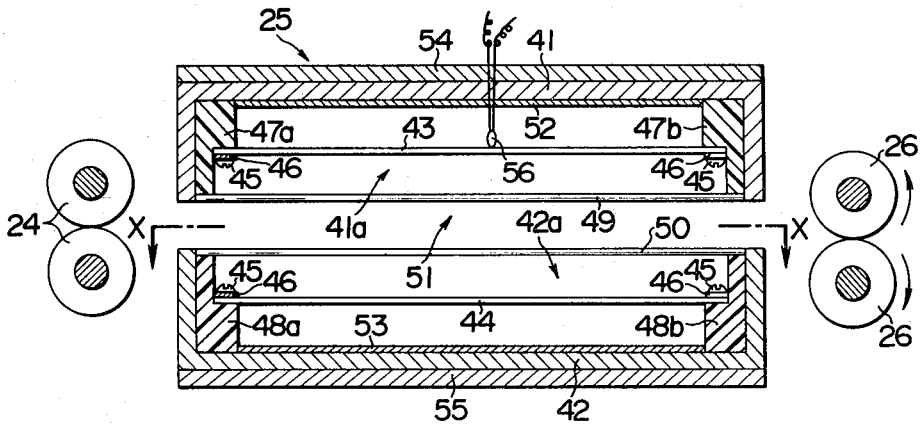
FIG. 2 (PRIOR ART)
FIG. 2 is a cross section of a heat fixing unit used in the apparatus of FIG. 1.
Figure 3:
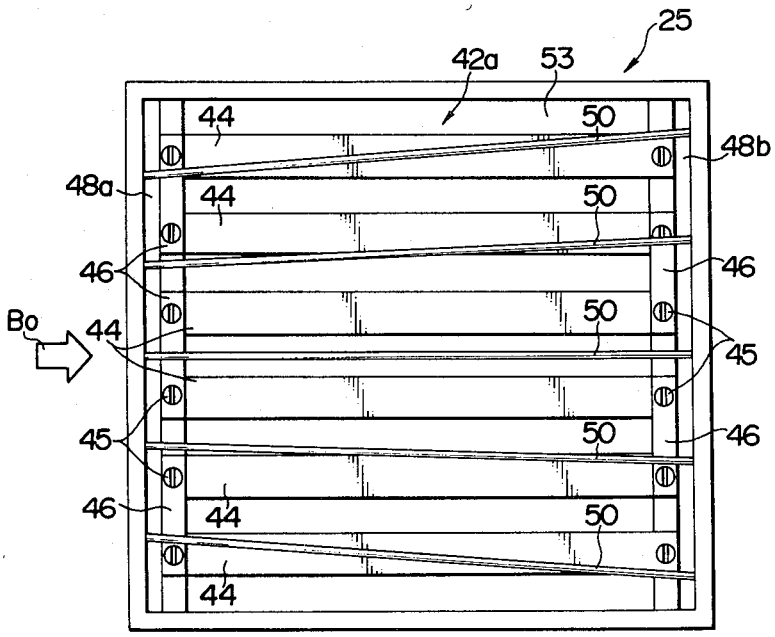
FIG. 3 is a plan view taken along the line X—X shown in FIG. 2.
Figure 9:
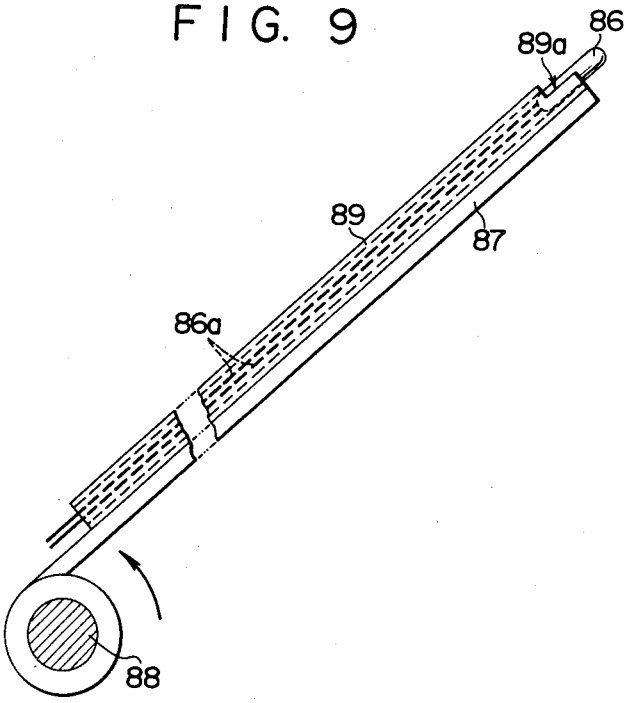
FIG. 9 is an enlarged side elevation of a support arm which carries the auxiliary temperature sensor shown in FIG. 8.
Figure 10:
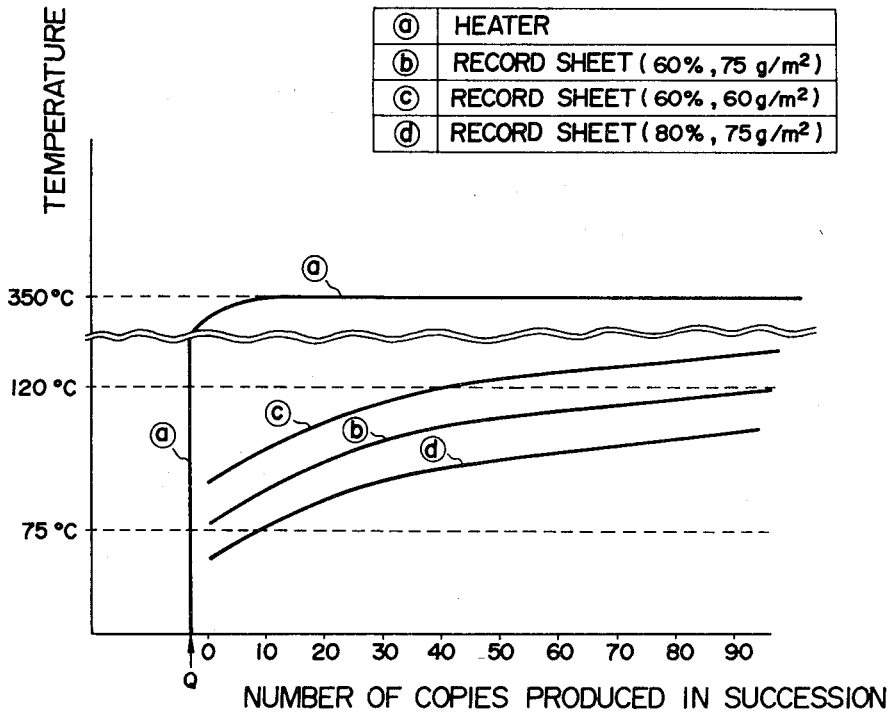
FIG. 10 graphically illustrates the temperature response of record sheets having different heat capacities.

FIG. 10 graphically shows the temperature of record sheets having different heat capacities which they assume immediately after they have passed through the fixing unit, by utilizing the auxiliary temperature sensor 86 disposed as shown in FIGS. 8 and 9, and also shows the temperature of the heaters 43 which is determined by the use of the main temperature sensor 56. In this Figure, the temperature of the heater 43 is indicated by a curve a. As shown, the temperature rises rapidly upon energization at time Q, and the temperature is maintained at 350°. The sensor 86 used comprises a thermistor having a diameter of 1.2 mm and a length of 3 mm. A curve b represents a temperature change of a record sheet having a density of 75 g/m$^2$ which is adjusted to the humidity of 60%. A curve c represents a temperature change of a record sheet having a density of 60 g/m$^2$ which is adjusted to the humidity of 60%. A curve d represents a temperature change of a record sheet having a density of 75 g/m$^2$ which is adjusted to the humidity of 80%. As shown, a difference in the heat capacity of the record sheets is reflected in a temperature difference between the record sheets, thus affecting the fixing performance. It will be evident from this Figure that when the output from the auxiliary sensor 86 is not used as a correction signal, or in a fixing unit utilizing a conventional temperature control as shown in FIG. 2, as the temperature of record sheets exceeds 120° C., there begins to appear an offset which is caused by the delivery rollers 26. On the other hand, a poor fixing result occurs for a temperature of the record sheet which is below 75° C. Thus it will be seen that the fixing unit cannot accommodate for record sheets having different heat capacities. FIG. 10 also indicates that while a satisfactory fixing operation is achieved for a particular record sheet when the number of copies produced in succession is small, there is a likelihood that an offset by the delivery rollers 26 may be caused when the number of copies increases which are produced in succession.

Figure 11:
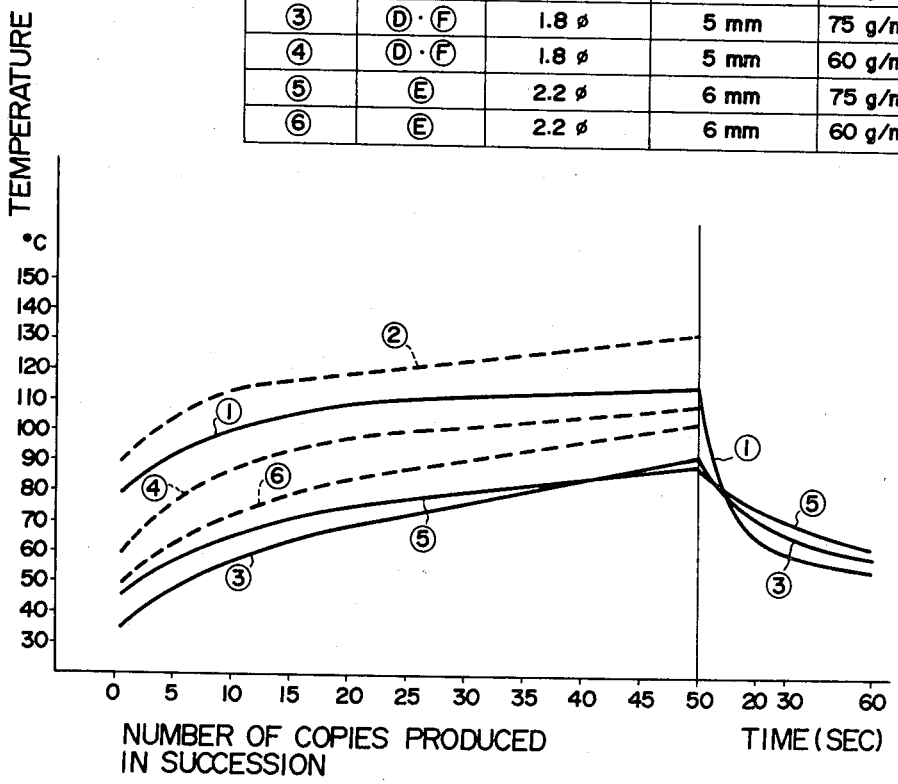
FIG. 11 graphically shows the temperature response of record sheets which are obtained when temperature sensors of different heat capacities are disposed at the locations shown in FIG. 7.
Figure 12:
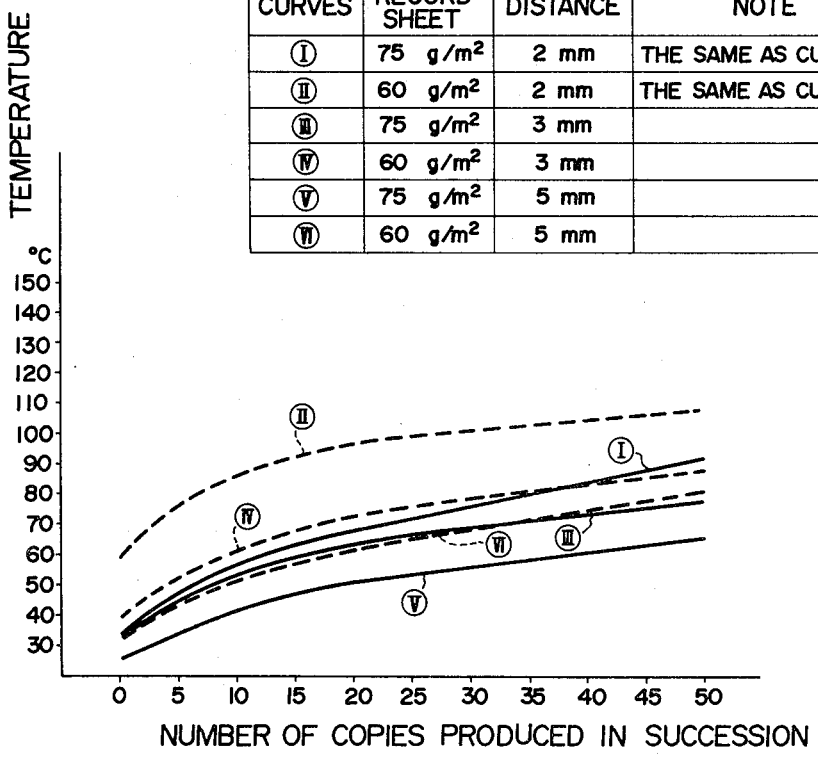
FIG. 12 graphically shows the temperature response when temperature sensor is located at successively increasing distances from the record sheet.

FIGS. 11 and 12 graphically show the temperatures and temperature changes as the location of the auxiliary sensor 86 is changed as illustrated in FIG. 7. Curves 1 and 2 in FIG. 11 represents the temperature of record sheets having a density of 75 g/m$^2$ and 61 g/m$^2$, respectively which is determined by a thermistor having a diameter of 1.2 mm and a length of 3 mm and disposed at location E shown in FIG. 7. Similarly, curves 3 and 4 represent the temperature of record sheets having a density of 75 g/m$^2$ and 60 g/m$^2$, respectively, which is determined by utilizing a thermistor having a diameter of 1.8 mm and a length of 5 mm which is selectively disposed at locations D and F shown in FIG. 7. It is to be noted that the locations D and F are below the path of the record sheet by a distance of 2 mm. Curves 5 and 6 represent the temperature of record sheets having a density of 75 g/m$^2$ and 60 g/m$^2$, respectively, which is determined by a thermistor having a diameter of 2.2 mm and a length of 6 mm and disposed at location E shown in FIG. 7. A temperature fall of the record sheet at 20 seconds, 30 seconds and 60 seconds after the passage of the last one of fifty copies produced in succession are shown for the curves 1, 3 and 5. It will be noted from curves 1 and 2 that when a thermistor having a small heat capacity is brought into contact with the record sheet, the temperature of the latter can be detected with the highest accuracy. A difference between the temperatures detected at the start and at the end of a copying operation during which fifty copies are produced in succession is not always the greatest. It is noted from curves 3 and 4 that a difference between temperatures at the start and at the end of a copying operation increases to a maximum value when a thermistor having a medium magnitude of heat capacity is disposed at a distance from the record sheet. Curves 5 and 6 indicate that the use of a thermistor having a high heat capacity does not produce a large difference in the temperatures if the thermistor is brought into contact with the record sheet. While not shown, it is found that when a thermistor having a high heat capacity is spaced from the record sheet by a distance of the order of 2 mm, the temperature difference between the start and the end of a copying operation is further reduced, and in addition the temperature difference between record sheets having densities of 60 g/m$^2$ and 75 g/m$^2$ reduces to the order of 5° C., which is unfavorable.

Hence it can be concluded that when an output from the auxiliary sensor 86 is utilized as a correction signal, the sensor should be disposed so that there is obtained a temperature variation between the start and the end of a copying operation which is as large as possible. It will be evident from FIG. 11 that when a thermistor having a medium magnitude of heat capacity is slightly spaced from the path of the record sheet, corresponding to the curves 3 and 4, a temperature difference which varies greatly can be detected. Accordingly, such an arrangement is preferred.

FIG. 12 graphically shows the results of measurement in which the thermistor having a diameter of 1.8 mm and a length of 5 mm and which has been used in the determination of curves 3 and 4 is successively removed from the record sheet. In this Figure, curves I and II represent data which is obtained when the thermistor is spaced by 2 mm from the record sheet, and thus the curves I and II remain the same as the curves 3 and 4 shown in FIG. 11. The curves III and IV represent data which is obtained when the thermistor is spaced by 3 mm from the record sheet while curves V and VI represent data which is obtained when the thermistor is spaced by 5 mm from the record sheet. It will be apparent from these curves that the temperature difference which can be detected decreases with an increasing distance of the thermistor from the record sheet. Since the temperature difference which can be detected is minimal when the thermistor is spaced from the record sheet by a distance which is equal to or greater than 5 mm, it is desirable that the magnitude of a shift in the output from the thermistor be amplified if an output from a sensor located in this manner is utilized as a correction signal.

Figure 13:
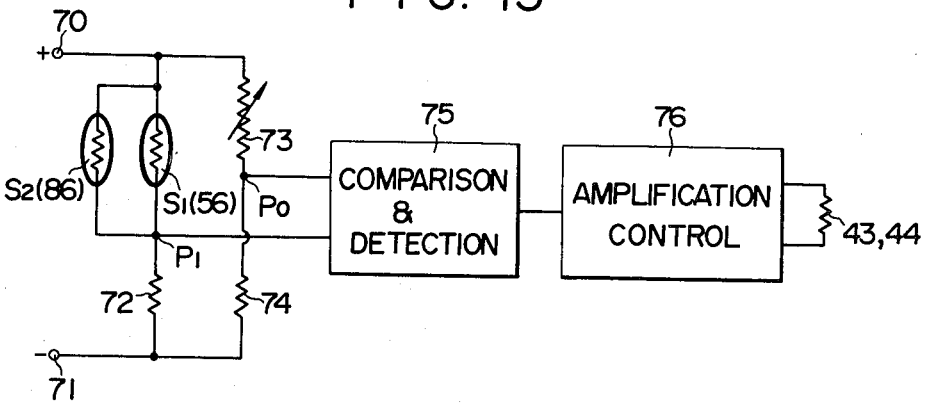
FIG. 13 is a circuit diagram of a temperature controller according to a first embodiment of the invention.

Several embodiments of the temperature controller according to the invention will now be described with reference to the drawings. FIG. 13 is a circuit diagram of a temperature controller according to a first embodiment of the invention. It will be noted that the electrical circuit of this temperature controller is constructed substantially in the same manner as that shown in FIG. 4 except that a thermistor $S_2$ which serves as the auxiliary sensor 86 is connected in shunt with the thermistor $S_1$ (or the main sensor 56) which detects the temperature of the heater 43 in its circuit portion where a detection signal is produced. The correction or auxiliary thermistor $S_2$ may be disposed at various locations as shown in FIGS. 7 and 8 and may have a variety of sizes. Since the temperature of a marginal member around the fixing unit 25 is low at the start of a copying operation or when the record sheet has an increased thickness or the record sheet has a high level of hygroscopicity, the thermistor $S_2$ then assumes a high resistance, and the composite resistance of the thermistors $S_1$ and $S_2$ is substantially equal to the resistance of the thermistor $S_1$ alone. Accordingly, this is equivalent to performing a temperature control by detecting the temperature of the heaters 43, 44 by utilizing the thermistor $S_1$ alone. Conversely, when a plurality of copies are produced in succession, or when the record sheet has a reduced thickness or is dry, the temperature of a marginal member around the fixing unit 25 is high, so that the thermistor $S_2$ then exhibits a reduced resistance, whereby the composite resistance of the thermistors $S_1$ and $S_2$ becomes lower than the resistance of the thermistor $S_1$ alone. Consequently, a signal indicative of the fact that a higher temperature is reached is produced at the junction $P_1$ between the parallel circuit of the thermistors $S_1$ and $S_2$ and the resistor 72. This signal is applied to the comparison and detection circuit 75, and is compared against the potential at the junction $P_0$ between the variable resistor 73 and the resistor 74, which form a reference generation circuit. As a consequence, the circuit 75 produces an output which is effective to reduce the potential difference between the junctions $P_1$ and $P_0$, and the output is applied to the amplification control circuit 76 which then operates to control the temperature of the heaters 43, 44 in a direction to reduce it.

Figure 4:
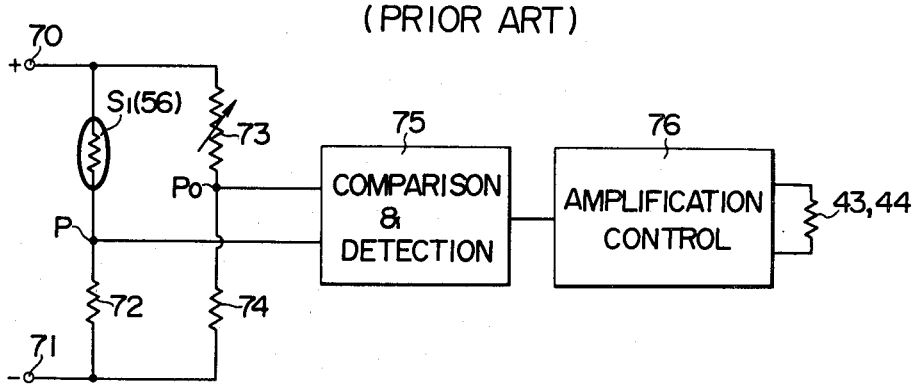
FIG. 4 (PRIOR ART)
FIG. 4 is a circuit diagram of one form of conventional temperature controller.
Figure 14:
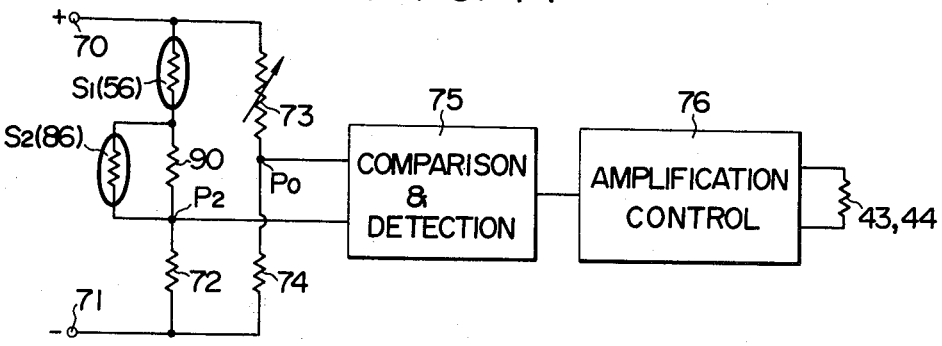
FIG. 14 is a circuit diagram of a temperature controller according to a second embodiment of the invention.

FIG. 14 is a circuit diagram of a temperature controller according to a second embodiment of the invention which is suitable for use with a correction thermistor $S_2$ having a low resistance. In this embodiment, the thermistor $S_1$ of the arrangement shown in FIG. 4 is connected in series with a correction resistor 90, which is shunted by a correction thermistor $S_2$ having a low resistance. The junction $P_2$ between the parallel connection of the correction resistor 90 and the thermistor $S_2$ and the resistor 72 is connected to the comparison and detection circuit 75 for applying a detection signal to the latter. If the resistance of the thermistor $S_2$ becomes close to zero, the dynamic range of correction is determined by the resistor 90, preventing an overcorrection by the thermistor $S_2$.

Figure 15:
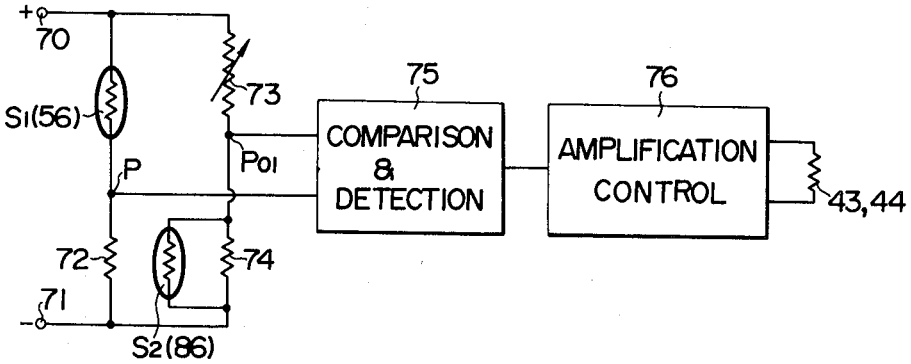
FIG. 15 is a circuit diagram of a temperature controller according to a third embodiment of the invention.

FIG. 15 is a circuit diagram of a temperature controller according to a third embodiment of the invention in which a correction signal is applied to a reference voltage generating circuit. A detection signal generating circuit is formed by a series combination of thermistor $S_1$ and resistor 72 in the same manner as the arrangement shown in FIG. 4. However, a reference voltage generating circuit is formed by a parallel combination of resistor 74 and thermistor $S_2$, connected in series with the variable resistor 73. Consequently, with this embodiment, when a marginal member remote from the heaters of the fixing unit assumes a high temperature to reduce the resistance of the thermistor $S_2$, the reference voltage level developed at the junction $P_{01}$ between the variable resistor 73 and parallel combination of the resistor 70 and thermistor $S_2$ decreases, whereby the combination of the comparison and detection circuit 75 and the amplification control circuit 76 operate to reduce the temperature of the heaters 43, 44.

Figure 16:
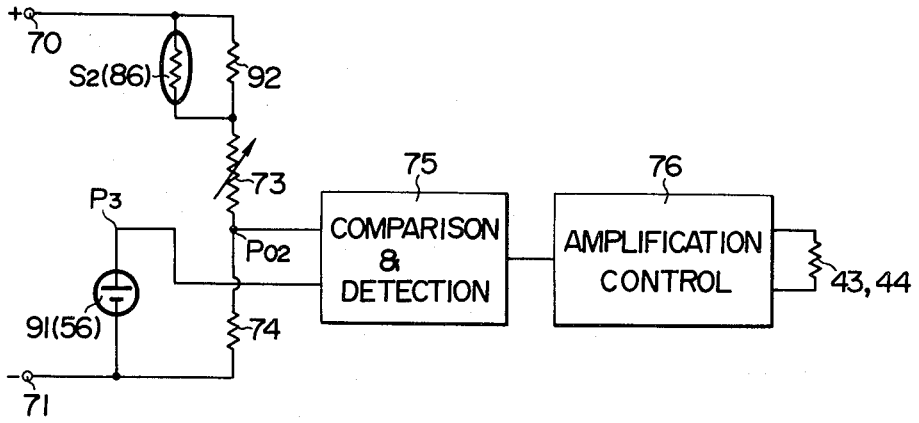
FIG. 16 is a circuit diagram of a temperature controller according to a fourth embodiment of the invention.

FIG. 16 is a circuit diagram of a temperature controller according to a fourth embodiment of the invention. In this embodiment, a thermocouple 91 is used as the main sensor 56 which detects the temperature of the heaters. The thermocouple 91 forms a circuit which produces a detection signal. A reference voltage generating circuit comprises a series combination of a variable resistor 73 and resistor 74 connected in series with a parallel combination of a correction resistor 92 and thermistor $S_2$, with the remote terminal of the parallel combination being connected to the terminal 70. The junction $P_{02}$ between the variable resistor 73 and resistor 74 as well as the anode $P_3$ of the thermocouple 91 are connected to the inputs of the comparison and detection circuit 75, which thus compared the potentials of these junctions against each other. The use of the thermocouple 91 as the main sensor 56 may make it difficult to provide a correction of the circuit which produces a detection signal. In such instance, the correction is provided by the parallel combination of the correction resistor 92 and thermistor $S_2$ which is disposed in the reference voltage generating circuit. The thermistor $S_2$ used in this circuit exhibits a low resistance as the thermistor $S_2$ used in the arrangement of FIG. 14, and hence the correction resistor 92 is used in order to prevent an excessive correction. In this embodiment, if the resistance of the thermistor $S_2$ is limited, the resistance of resistors 92, 73 and 74 can be freely chosen in accordance with the resistance of the thermistor $S_2$.

In the temperature controller of FIG. 16, the thermocouple 91 is used as the main temperature sensor 56 instead of thermistor $S_1$. In this instance, a variety of auxiliary sensors 86 may be used and a variety of manners are available in which a correction signal is applied. For example, the auxiliary sensor 86 is not limited to thermistor $S_2$, and the correction signal is not limited to an analog signal, but may be an on-off signal or a multi-value digital signal. An on-off signal can be derived by using a thermal reed switch or a bimetal switch as the auxiliary sensor. A multi-value digital signal can be derived by passing an analog signal from a thermistor or a thermocouple through an A-D converter or applying it to a comparison and detection circuit having a plurality of different operating levels. In a corresponding manner, the temperature control may be performed at a plurality of levels in accordance with the individual value of the digital signal.

Figure 17:
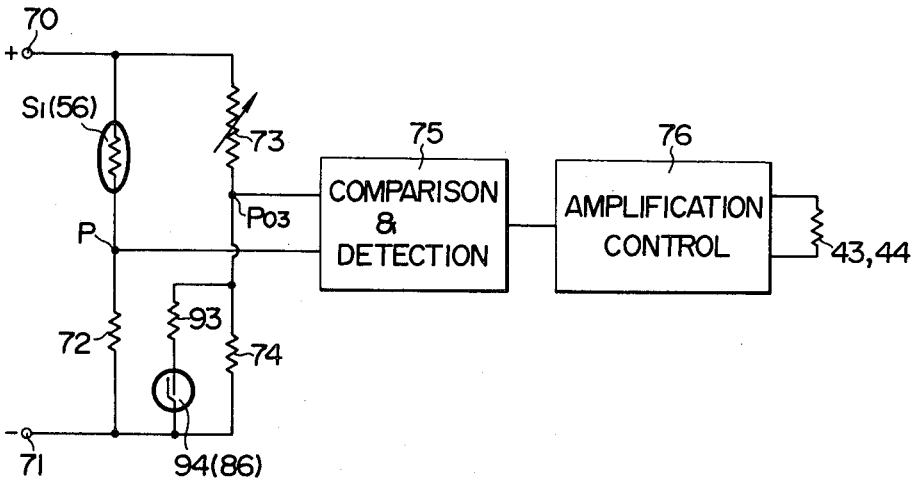
FIG. 17 is a circuit diagram of a temperature controller according to a fifth embodiment of the invention.

FIG. 17 is a circuit diagram of a temperature controller according to a fifth embodiment of the invention. In this embodiment, a thermal reed switch 94 is used as the auxiliary sensor 86 of the reference voltage generating circuit in order to produce a correction signal in the form of an on-off signal. Specifically, the resistor 74 in the reference voltage generating circuit shown in FIG. 4 is shunted by a series combination of a resistor 93 and thermal reed switch 94. The thermal reed switch 94 has its contacts closed or turned on to be conductive when subjected to an elevated temperature. Consequently, when a marginal member which is remote from the heaters 43 of the fixing unit 25 assumes a higher temperature it renders the thermal reed switch 94 conductive. The resistor 74 is shunted by the resistor 93 to reduce the composite resistance to a value less than that of the resistor 74. Accordingly, a reference potential at a junction $P_{03}$ between the variable resistor 73 and resistor 74 decreases, whereby the comparison and detection circuit 75 and the amplification control circuit 76 operate to reduce the temperature of the heaters 43, 44. The provision of the resistor 93 is essential in a fixing unit having a rapid response in order to prevent the control effect from becoming excessive. However, in a fixing unit having a slow response, the resistor 93 may be eliminated since the control effect is automatically suppressed.

Figure 5:
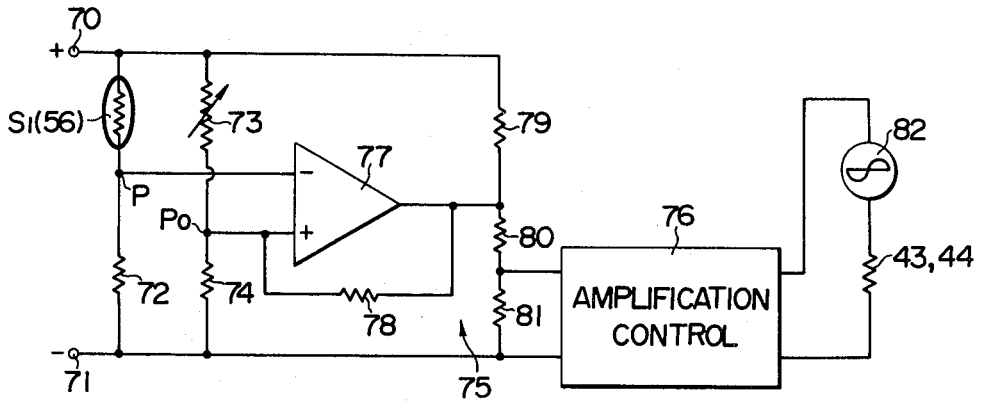
FIG. 5 (PRIOR ART)
FIG. 5 is a circuit diagram of a specific circuit arrangement of the temperature controller shown in FIG. 4.

The temperature controlling effects obtained with the invention will now be described with reference to FIG. 18. In this Figure, curves 1 and 2 represent the same response as the curves 1 and 2 shown in FIG. 11, and are derived by disposing a thermistor at a location indicated in FIG. 8 or at location E of FIG. 7 to determine a temperature change of the record sheet in a fixing unit which incorporates the temperature control of a conventional arrangement shown in FIGS. 4 and 5. Curves 3 and 4 represent a temperature change of the record sheet which is determined by utilizing the temperature controller according to the third embodiment of the invention shown in FIG. 15 and by utilizing as the correction thermistor $S_2$ that one which is used to derive the curves 3 and 4 of FIG. 11 and which is disposed at location D or F shown in FIG. 7. In this instance, the thermistors $S_1$ and $S_2$ in the arrangement of FIG. 15 exhibit the same resistance response. Their resistance varies with the temperature, exhibiting 200 KΩ at 30° C., 60 KΩ at 60° C., 40 KΩ at 70° C., 30 KΩ at 80° C., 22 KΩ at 90° C., 16 KΩ at 100° C. and 12 KΩ at 110° C. The resistors 72, 74 have an equal resistance of 5 KΩ while the resistance of the variable resistor 73 is equal to 500Ω. The curve 3 indicates the use of a record sheet having a density of 75 g/m$^2$ and corresponds to the curve 1 while the curve 4 indicates the use of a record sheet having a density of 60 g/m$^2$ and corresponds to the curve 2.

It is noted from the comparison of the curves 1 and 3 that for the curve 1, the record sheet undergoes a rapid temperature rise with an increase in the number of copies which are produced in succession and the tendency of temperature rise does not appear to be suppressed after fifty copies have been produced in succession while for the curve 3, the correction by the thermistor $S_2$ becomes effective after five to ten copies have been produced in succession, with no tendency to increase the temperature of the record sheet after fifteen copies have been produced.

Similarly, it is seen from the comparison between the curves 2 and 4 that for the curve 2, the record sheet undergoes a rapidly increasing temperature rise with an increase in the number of copies which are produced in succession and the temperature rise does not cease even after fifty copies have been produced in succession. When the temperature of the record sheet exceeds 120° C. around the delivery rollers 26, there begins to appear an offsetting by the delivery rollers 26, and the record sheet becomes scorched when 140° C. is exceeded. By contrast, it will be seen from the curve 4 that the temperature of the record sheet is maintained approximately at 110° C. after about ten copies have been produced in succession with no tendency toward a further temperature rise. In this manner, the problems experienced with the curve 2 are overcome.

When a record sheet having a density of 60 g/m$^2$ is used in a conventional temperature controller, an offsetting by the delivery rollers 26 is caused after twentyfive copies have been produced in succession. An offsetting occurs with a record sheet having a density of 75 g/m$^2$ after one hundred copies have been produced in succession. However, with the temperature controller of the invention, there occurs no further temperature rise after ten to fifteen copies have been produced in succession, thus overcoming the problems experienced with the prior arrangement. If it is attempted to overcome such problems with the conventional temperature controller, the only remedy is to reduce the temperature level of the fixing unit, which results in an insufficient fixing of humid or thick record sheets as mentioned previously.

Figure 18:
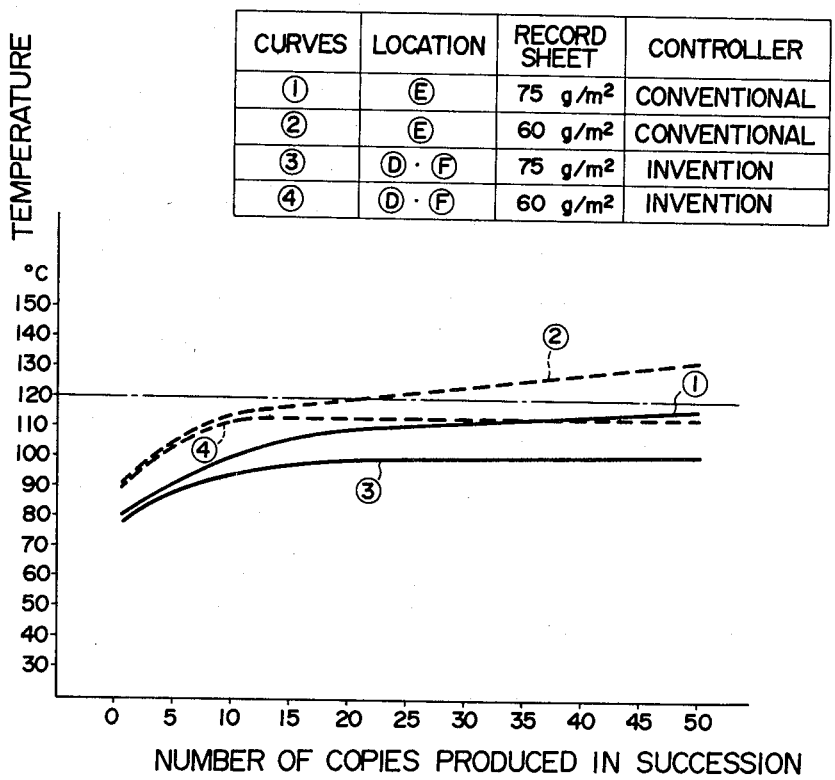
FIG. 18 graphically shows the temperature response of record sheets, illustrating a comparative performance between a conventional temperature controller and the temperature controller of the invention.

When the temperature controller according to the first embodiment of the invention shown in FIG. 13 is used in which the auxiliary sensor or correction thermistor $S_2$ comprises the one used to derive the curves 5 and 6 of FIG. 11 while producing a number of copies in succession, results are obtained which are substantially similar to those indicated by the curves 3 and 4 of FIG. 18. The thermistor $S_2$ used exhibited a resistance of 4.4 KΩ at 50° C., 2.3 KΩ at 70° C. and 1.3 KΩ at 90° C.

As a further illustration, the temperature controller according to the fifth embodiment of the invention shown in FIG. 17 is used in which the thermal reed switch 94, functioning as the auxiliary sensor 86, is disposed at locations F and G of FIG. 7. The thermal reed switch 94 is adjusted so that it produces an output to produce an off-off signal in response to a temperature of 90° C. at location F and 70° C. at location G. In a circuit arrangement in which the resistor 93 is eliminated and the resistor 74 is short-circuited when the thermal reed switch 94 becomes conductive, there results an insufficient fixing of copies for a prolonged period of time during which the thermal reed switch 94 remains conductive after a number of copies have been produced in succession, irrespective of the location F or G where the switch 94 is disposed. However, when the resistor 93 having a resistance of 1.5 KΩ is used, a favorable temperature control is achieved when the thermal reed switch 94 is disposed at location G. When the switch 94 is disposed at location F, there results a degree of non-uniformity in the fixing result, but there occurred no insufficient fixing or offsetting.

Figure 6:
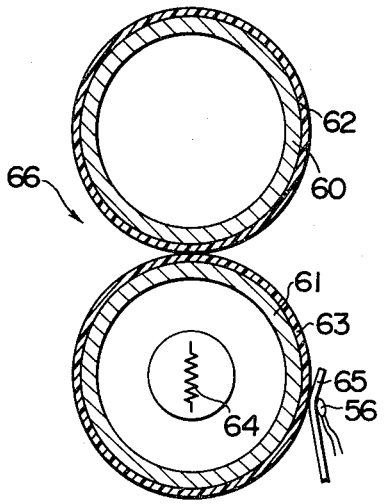
FIG. 6 (PRIOR ART)
FIG. 6 is a cross section showing another form of heat fixing unit.

In the above embodiments, the temperature controller is used with the photographic heat fixing unit 25 of the open type which incorporates ribbon-shaped heaters. However, it should be understood that these temperature controllers may also be used with other fixing units such as the heat roll fixing unit 66 shown in FIG. 6, for example, to perform a correction of temperature control by the auxiliary sensor 86. In these instances, the auxiliary sensor 86 is disposed at a suitable location spaced from the heater or heaters of the fixing unit depending on the desired control response. By way of example, when it is desired to provide a correction of only a change in the fixing performance which results from a temperature rise of marginal members around a fixing unit after a number of copies have been produced in succession, the auxiliary sensor 86 may be disposed at the location of such marginal member. On the other hand, if it is desired to compensate for a change in the fixing performance which results from the degree of hygroscopicity or thickness of the record sheets, it is desirable that the auxiliary sensor 86 be disposed close to the path of record sheet or in contact with the record sheet in order to reflect the temperature information of the record sheet more accurately.

When the auxiliary sensor 86 is disposed close to the record sheet, there occurs a drift in the detection signal as the record sheet moves away from the sensor 86. However, such drift can be accommodated for by increasing the heat capacity of the sensor 86, by averaging it out in a buffer circuit, or by sampling and holding the detection signal.

What is claimed is:

1. A temperature controller for a photographic heat fixing unit, comprising:

temperature control means for controlling the temperature of a heater or heaters in the heat fixing unit, the temperature control means including a main temperature sensor for detecting the temperature of a heater or heaters in the fixing unit, and an auxiliary temperature sensor for detecting the temperature of a marginal member spaced from the heater or of a record sheet; and said auxiliary sensor being disposed at a small distance from a path along which a record sheet runs after it has left the heat fixing unit.

2. A temperature controller for a photographic heat fixing unit, comprising:

temperature control means for controlling the temperature of a heater or heaters in the heat fixing unit, the temperature control means including a main temperature sensor for detecting the temperature of a heater or heaters in the fixing unit, and an auxiliary temperature sensor for detecting the temperature of a marginal member spaced from the heater or of a record sheet; and said auxiliary sensor being disposed for contact with a record sheet as it leaves the fixing unit.

3. A temperature controller for a photographic heat fixing unit, comprising:

temperature control means for controlling the temperature of a heater or heaters in the heat fixing unit, the temperature control means including a main temperature sensor for detecting the temperature of a heater or heaters in the fixing unit, and an auxiliary temperature sensor for detecting the temperature of a marginal member spaced from the heater or of a record sheet; and said temperature control means comprising a detection signal generating circuit including the main and the auxiliary temperature sensor for generating a detection signal, a reference voltage generating circuit for generating a reference voltage, a comparison and detection circuit for comparing the detection signal and the reference voltage against each other to produce a signal in accordance with a voltage difference therebetween, and an amplification control circuit for amplifying a signal from the comparison and detection circuit and for controlling the energization of the heater or heaters in accordance with the amplified signal.

4. A temperature controller according to claim 3 in which the detection signal generating circuit includes a thermistor and a resistor connected in series across a pair of terminals across which a d.c. voltage of a given magnitude is applied, the thermistor forming the main temperature sensor, the auxiliary sensor being formed by another thermistor which is connected in parallel with the main temperature sensor, the circuit producing a detection signal at a junction between the main sensor and the resistor.

5. A temperature controller according to claim 3 in which the detection signal generating circuit comprises a thermistor, a correction resistor and another resistor connected in series across a pair of terminals across which a d.c. voltage of a given magnitude is applied, the thermistor forming the main temperature sensor, the auxiliary temperature sensor being formed by another thermistor having a relatively low resistance and connected in parallel with the correction resistor, the circuit producing a detection signal at a junction between the correction resistor and said another resistor.

6. A temperature controller according to claim 3 in which the reference voltage generating circuit comprises a variable resistor and a fixed resistor connected in series across a pair of terminals across which a d.c. voltage of a given magnitude is applied, the circuit producing a reference voltage at a junction between the variable and the fixed resistor.

7. A temperature controller for a photographic heat fixing unit, comprising:

temperature control means for controlling the temperature of a heater or heaters in the heat fixing unit, the temperature control means including a main temperature sensor for detecting the temperature of a heater or heaters in the fixing unit, and an auxiliary temperature sensor for detecting the temperature of a marginal member spaced from the heater or of a record sheet; and said temperature control means comprising a detection signal generating circuit including the main temperature sensor for producing a detection signal, a reference voltage generating circuit including the auxiliary temperature sensor for producing a reference voltage, a comparison and detection circuit for comparing the detection signal and the reference voltage against each other to produce a signal in accordance with a voltage difference therebetween, and an amplification control circuit for amplifying a signal from the comparison and detection circuit for controlling the energization of the heater or heaters in accordance with the amplified signal.

8. A temperature controller according to claim 7 in which the detection signal generating circuit comprises a thermistor and a resistor connected in series across a pair of terminals across which a d.c. voltage of a given magnitude is applied, the thermistor forming the main temperature sensor, the circuit producing a detection signal at a junction between the main sensor and the resistor.

9. A temperature controller according to claim 7 in which the detection signal generating circuit includes a thermocouple as the main temperature sensor which has its one electrode connected to a terminal to which a supply voltage is applied, the other electrode of the main sensor being operative to produce a detection signal.

10. A temperature controller according to claim 7 in which the reference voltage generating circuit comprises a variable resistor and a fixed resistor connected in series across a pair of terminals across which a d.c. voltage of a given magnitude is applied, the auxiliary temperature sensor being formed by a thermistor which is connected in parallel with the fixed resistor, the circuit producing a reference voltage at a junction between the variable and the fixed resistor.

11. A temperature controller according to claim 7 in which the reference voltage generating circuit comprises a correction resistor, a variable resistor and a fixed resistor connected in series across a pair of terminals across which a d.c. voltage of a given magnitude is applied, the auxiliary temperature sensor being formed by a thermistor having a relatively low resistance which is connected in parallel with the correction resistor, the circuit producing a reference voltage at a junction between the variable and the fixed resistor.

12. A temperature controller according to claim 7 in which the reference voltage generating circuit comprises a variable resistor and a fixed resistor connected in series across a pair of terminals across which a d.c. voltage of a given magnitude is applied, the auxiliary temperature sensor being formed by a thermal reed switch which is connected in parallel with the fixed resistor, the circuit producing a reference voltage at a junction between the variable and the fixed resistor.

13. A temperature controller according to claim 12 in which another resistor is connected in series with the auxiliary temperature sensor.

14. A temperature controller for controlling the temperature of a heater in a photographic heat fixing unit for fixing a record sheet, comprising:

a main temperature sensor for detecting the operating temperature of a heater disposed inside the fixing unit;

said fixing unit including other parts which are heated by said heater and contribute heat to said record sheet;

an auxiliary temperature sensor for detecting the temperature of at least one of said other parts of said fixing unit other than said heater; and means responsive to said main and auxiliary temperature sensors for regulating the operating temperature of said heater.

15. A temperature controller according to claim 14 in which said regulating means comprises a detection signal generating circuit including said main and auxiliary temperature sensors for generating a detection signal, a reference voltage generating circuit for generating a reference voltage, a comparison and detection circuit for comparing the detection signal and the reference voltage against each other to produce an output signal in accordance with a voltage difference therebetween, and means for controlling the energization of said heater in accordance with said output signal.

16. A temperature controller according to claim 14 in which said regulating means comprises a detection signal generating circuit including said main temperature sensor for generating a detection signal, a reference voltage generating circuit including said auxiliary temperature sensor for generating a reference voltage, a comparison and detection circuit for comparing the detection signal and the reference voltage against each other to produce an output signal in accordance with a voltage difference therebetween, and means for controlling the energization of said heater in accordance with said output signal.

* * * * *

UNITED STATES PATENT AND TRADEMARK OFFICE

CERTIFICATE OF CORRECTION

PATENT NO. : 4,367,037
DATED : January 4, 1983
INVENTOR(S) : Masaji Nishikawa

It is certified that error appears in the above—identified patent and that said Letters Patent is hereby corrected as shown below:

IN THE ABSTRACT:

Line 3, after "temperature" insert --sensor--.

Column 7, line 48, delete "a"; and after "disposed at" insert --a--.

Signed and Sealed this

Fourteenth Day of June 1983

[SEAL]

*Attest:*

DONALD J. QUIGG

*Attesting Officer*

*Acting Commissioner of Patents and Trademarks*